US012193508B2

(12) United States Patent
Kane et al.

(10) Patent No.: US 12,193,508 B2
(45) Date of Patent: Jan. 14, 2025

(54) ELECTRONIC SMOKING ARTICLE

(71) Applicant: Altria Client Services LLC, Richmond, VA (US)

(72) Inventors: David B. Kane, Richmond, VA (US); David R. Schiff, Highland Park, VA (US); Chris Carrick, Newark, DE (US); Chris Phelan, Richmond, VA (US); Christopher S. Tucker, Midlothian, VA (US)

(73) Assignee: Altria Client Services LLC, Richmond, VA (US)

( * ) Notice: Subject to any disclaimer, the term of this patent is extended or adjusted under 35 U.S.C. 154(b) by 129 days.

(21) Appl. No.: 17/160,633

(22) Filed: Jan. 28, 2021

(65) Prior Publication Data

US 2021/0145054 A1 May 20, 2021

Related U.S. Application Data

(63) Continuation of application No. 16/106,058, filed on Aug. 21, 2018, now Pat. No. 10,905,165, which is a continuation of application No. 14/200,963, filed on Mar. 7, 2014, now Pat. No. 10,098,381.

(60) Provisional application No. 61/798,891, filed on Mar. 15, 2013.

(51) Int. Cl.

| | |
|---|---|
| ***A24F 40/485*** | (2020.01) |
| ***A24F 40/10*** | (2020.01) |
| ***A24F 40/42*** | (2020.01) |

(52) U.S. Cl.

CPC ..... *A24F 40/485* (2020.01); *A24F 40/42* (2020.01); *A24F 40/10* (2020.01)

(58) Field of Classification Search

CPC .... A24F 47/008; A24F 42/002; A24F 47/004; A24F 40/10; A24F 40/42; A24F 40/485

See application file for complete search history.

(56) References Cited

U.S. PATENT DOCUMENTS 3,490,461 A * 1/1970 Pasquine ..... A24D 3/043 131/198.1
4,580,584 A * 4/1986 Reynolds ..... A24D 3/043 131/336

(Continued)

FOREIGN PATENT DOCUMENTS

CN 102655773 A 9/2012
EA 009116 10/2007

(Continued)

OTHER PUBLICATIONS

Machine Translation of WO 2013/030202 (Year: 2023).*

(Continued)

*Primary Examiner* — Russell E Sparks
(74) *Attorney, Agent, or Firm* — Harness, Dickey & Pierce, P.L.C.

(57) ABSTRACT

An electronic smoking article includes a heater in communication with a liquid supply reservoir including liquid material and operable to heat the liquid material to a temperature sufficient to volatilize the liquid material contained therein and form an aerosol. The volatilized material flows through a sheath flow and aerosol promoter insert that is operable to cool the aerosol, reduce the particle size of the aerosol and increase the delivery rate of the aerosol.

18 Claims, 4 Drawing Sheets

(56) References Cited

U.S. PATENT DOCUMENTS

| | | | | | |
|---|---|---|---|---|---|
| 4,708,150 | A * | 11/1987 | Lamb | A24D 3/043 131/336 |
| 4,945,931 | A | 8/1990 | Gori | |
| 5,692,291 | A | 12/1997 | Deevi et al. | |
| 6,516,796 | B1 | 2/2003 | Cox et al. | |
| 7,726,320 | B2 * | 6/2010 | Robinson | A24B 15/167 131/194 |
| 7,878,962 | B2 * | 2/2011 | Karles | A24D 3/0287 493/47 |
| RE49,114 | E * | 6/2022 | Newton | A24F 40/42 |
| 2006/0196518 | A1 | 9/2006 | Hon | |
| 2007/0267032 | A1 | 11/2007 | Shan | |
| 2011/0094523 | A1 | 4/2011 | Thorens et al. | |
| 2011/0277764 | A1 | 11/2011 | Terry et al. | |
| 2012/0230659 | A1 | 9/2012 | Goodman et al. | |
| 2013/0180533 | A1 * | 7/2013 | Kim | A24F 40/42 131/273 |
| 2013/0228191 | A1 | 9/2013 | Newton | |
| 2014/0076310 | A1 | 3/2014 | Newton | |
| 2014/0224268 | A1 * | 8/2014 | Ryter | A24D 3/068 493/39 |
| 2014/0334802 | A1 | 11/2014 | Dubief | |

FOREIGN PATENT DOCUMENTS

| | | | | |
|---|---|---|---|---|
| EP | 0845220 | A1 | 6/1998 | |
| EP | 2319334 | A1 | 5/2011 | |
| GB | 2466758 | A | 7/2010 | |
| JP | 2007511437 | A | 5/2007 | |
| KZ | 27104 | B | 6/2013 | |
| RU | 121706 | U1 | 11/2012 | |
| WO | WO-95/27412 | A1 | 10/1995 | |
| WO | WO-9823171 | A1 | 6/1998 | |
| WO | WO-2010010391 | A1 | 1/2010 | |
| WO | WO-2010/133342 | A1 | 11/2010 | |
| WO | WO-2011045066 | A1 | 4/2011 | |
| WO | WO-2011050943 | A1 * | 5/2011 | A24B 15/16 |
| WO | WO-2013030202 | A1 * | 3/2013 | A24F 47/006 |
| WO | WO-2013/102609 | A2 | 7/2013 | |

OTHER PUBLICATIONS

International Search Report and Written Opinion dated Oct. 16, 2014.

Office Action from corresponding Kazakhstan patent application 2015/1181.1, dated Mar. 11, 2014.

Office Action for corresponding Chinese Application No. 201480016127.0 dated May 16, 2017 and English translation thereof.

Search Report for corresponding Russian Application No. 2015144320/12 dated May 10, 2018 and English translation thereof.

European Examination Report for Application No. 14719140.7-1005 dated Sep. 27, 2018.

Malaysian Substantive Examination Adverse Report for corresponding Application No. PI 2015002212 dated Mar. 29, 2019.

Indian Office Action for corresponding Application No. 5526/CHENP/2015 dated Apr. 23, 2019, English translation thereof.

* cited by examiner

ELECTRONIC SMOKING ARTICLE

CROSS-REFERENCE TO RELATED APPLICATION

This application is a continuation of U.S. patent application Ser. No. 16/106,058, filed Aug. 21, 2018, which is a continuation of U.S. patent application Ser. No. 14/200,963, filed on Mar. 7, 2014, and claims priority under 35 U.S.C. § 119(e) to U.S. provisional Application No. 61/798,891, filed on Mar. 15, 2013, the entire contents of each of which are incorporated herein by reference thereto.

WORKING ENVIRONMENT

Many of the embodiments disclosed herein include electronic smoking articles operable to deliver liquid from a liquid supply reservoir to a heater. The heater volatilizes a liquid to form an aerosol.

SUMMARY

An electronic smoking article comprises a sheath flow and aerosol promoter (SFAP) insert operable to produce a sheath airflow within the electronic smoking article and operable to direct an aerosol through a constriction whereby aerosol formation is enhanced and losses due to condensation within the electronic smoking article are abated.

A method of reducing the particle size of an aerosol of an electronic smoking article and increasing the delivery rate of the aerosol. The method comprises heating a liquid material to a temperature sufficient to form a vapor, mixing the vapor and air in a mixing chamber to form an aerosol, passing the aerosol through a constriction to cool the aerosol, and buffering the aerosol with sheath air as the aerosol passes through a growth cavity so as to substantially prevent condensation of the aerosol on an inner surface of the growth cavity.

DETAILED DESCRIPTION

An electronic smoking article includes a sheath flow and aerosol promoter (SFAP) insert operable to produce and deliver an aerosol that is similar to cigarette smoke. Once a vapor is generated, the vapor flows into the SFAP insert and is cooled by air which enters the electronic smoking article downstream of a heater. The SFAP insert includes a constriction which can quickly cool the vapor by reducing the cross-section of the vapor flow so as to transfer heat from the center of the aerosol flow to walls of the SFAP insert faster. The increased cooling rate increases the rate of aerosol particle formation resulting in smaller particle sizes. Upon passing through the constriction portion of the SFAP insert, the aerosol is allowed to expand and further cool, which enhances aerosol formation. Channels provided on an exterior of the SFAP allow aerosol-free (sheath) air to be drawn into a mixing chamber downstream of the SFAP insert where the sheath air produces a boundary layer that is operable to minimize condensation of the aerosol on walls of the electronic smoking article so as to increase the delivery rate of the aerosol.

The SFAP insert can be used in an electronic smoking article including a heated capillary aerosol generator (CAG) or a heater and wick assembly as described herein. Electronic smoking articles including the CAG can include a manual pump or a pressurized liquid source and valve arrangement. The valve can be manually or electrically actuated.

Figure 1:
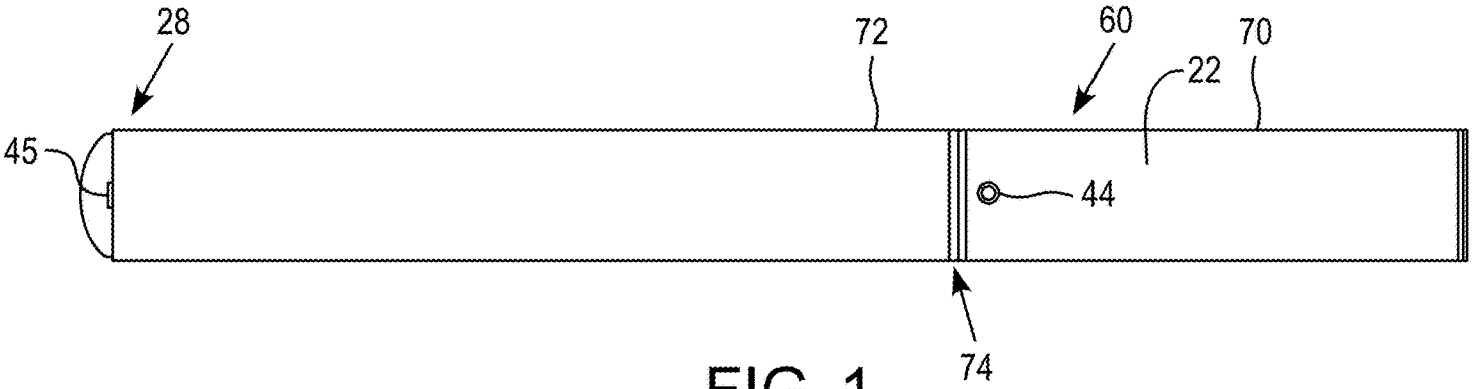
FIG. 1 is a side view of an electronic smoking article constructed according to the teachings herein.

As shown in FIG. 1, an electronic smoking article 60 comprises a replaceable cartridge (or first section) 70 and a reusable fixture (or second section) 72, which are coupled together at a threaded joint 74 or by other convenience such as a snug-fit, snap-fit, detent, clamp and/or clasp.

Figure 2:
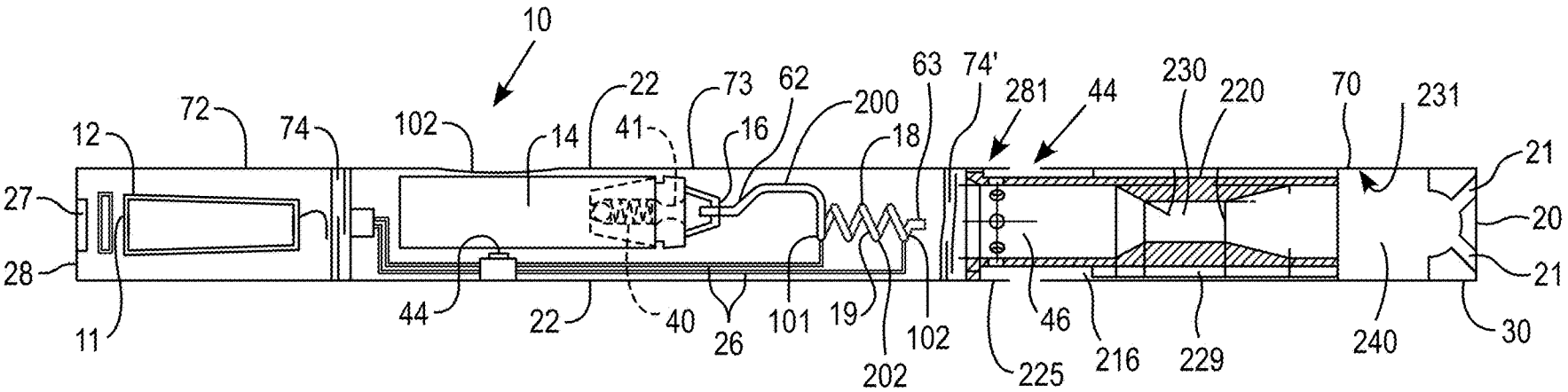
FIG. 2 is a cross-sectional view of an electronic smoking article according to a first embodiment and including a sheath flow and aerosol promoter (SFAP) insert according to a first embodiment.
Figure 7:
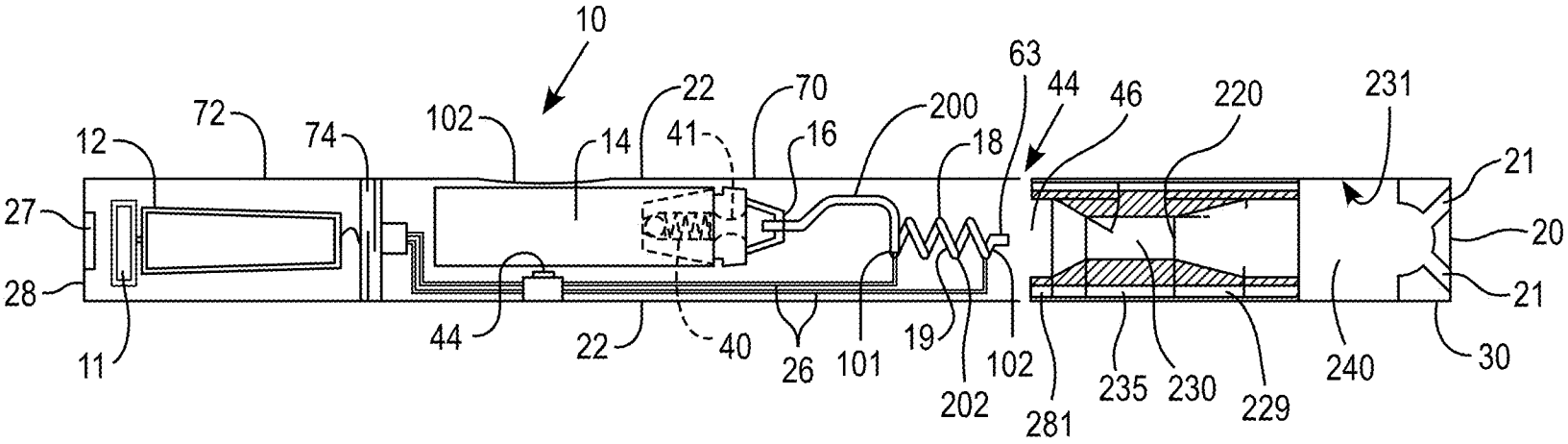
FIG. 7 is a cross-sectional view of the electronic smoking article of FIG. 2 including a SFAP insert according to a second embodiment.
Figure 8:
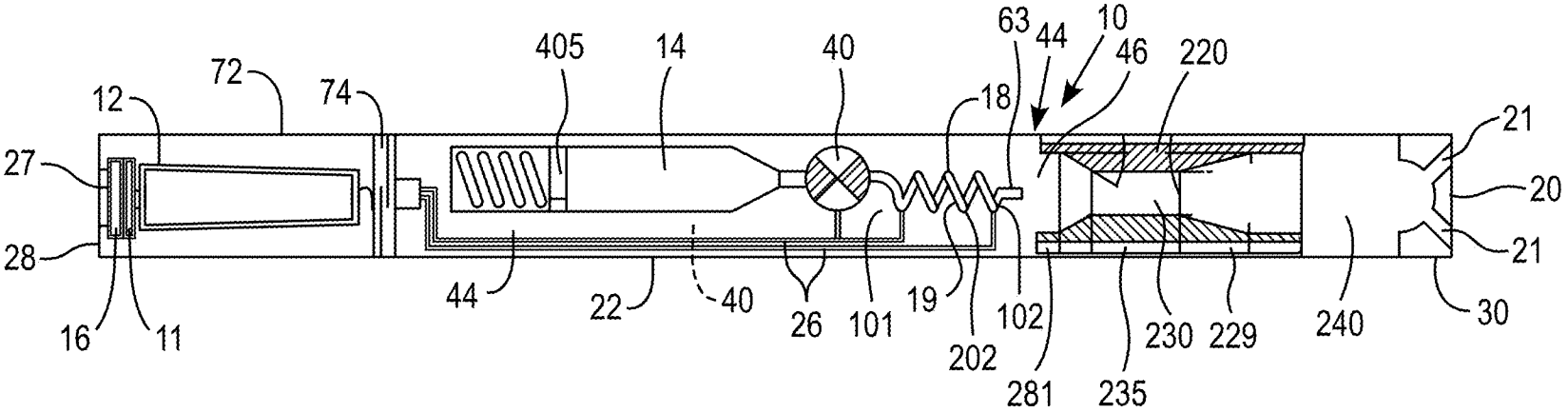
FIG. 8 is a cross-sectional view of another embodiment of an electronic smoking article including the SFAP insert of FIG. 7.

As shown in FIGS. 2, 7 and 8, the first section 70 can house a mouth-end insert 20, a sheath flow and aerosol promoter (SFAP) insert 220, a capillary aerosol generator including a capillary tube 18, a heater 19 to heat at least a portion of the capillary tube 18, a liquid supply reservoir 14 and optionally a valve 40. Alternatively, as shown in FIG. 9, the first section 70 can house a mouth end insert 20, a SFAP insert 220, a heater 319, a flexible, filamentary wick 328 and a liquid supply reservoir 314 as discussed in further detail below.

Figure 9:
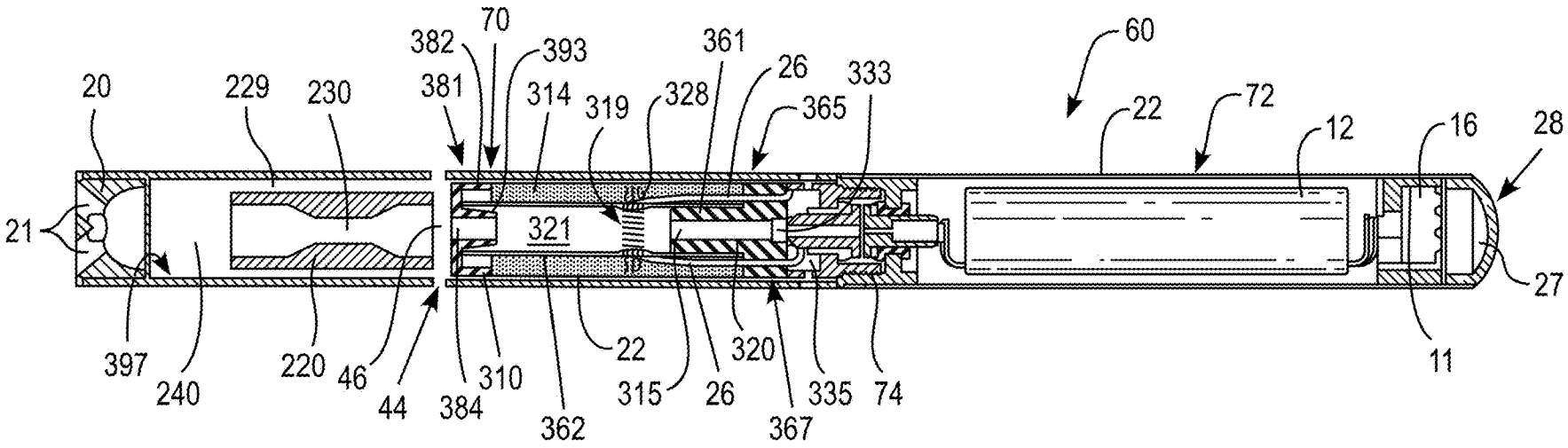
FIG. 9 is a cross-sectional view of another embodiment of an electronic smoking article including the SFAP insert of FIG. 7.

The second section 72 can house a power supply 12 (shown in FIGS. 2, 7, 8 and 9), control circuitry 11 (shown in FIGS. 2, 7 and 8), and optionally a puff sensor 16 (shown in FIGS. 8 and 9). The threaded portion 74 of the second section 72 can be connected to a battery charger when not connected to the first section 70 for use so as to charge the battery.

As shown in FIG. 2, the electronic smoking article 10 can also include a middle section (third section) 73, which can house the liquid supply reservoir 14, heater 19 and valve 40. The middle section 73 can be adapted to be fitted with a threaded joint 74' at an upstream end of the first section 70 and a threaded joint 74 at a downstream end of the second section 72. In this embodiment, the first section 70 houses the SFAP insert 220 and the mouth-end insert 20, while the second section 72 houses the power supply 12 and control circuitry.

Preferably, the first section 70, the second section 72 and the optional third section 73 include an outer cylindrical housing 22 extending in a longitudinal direction along the length of the electronic smoking article 60. Moreover, in one embodiment, the middle section 73 is disposable and the first section 70 and/or second section 72 are reusable. In another embodiment, the first section 70 can also be replaceable so as to avoid the need for cleaning the capillary tube 18 and/or heater 19. The sections 70, 72, 73 can be attached by threaded connections whereby the middle section 73 can be replaced when the liquid in the liquid supply reservoir 14 is depleted.

As shown in FIG. 2, the outer cylindrical housing 22 can include a cutout or depression 100 which allows a smoker to manually apply pressure to the liquid supply reservoir 14. Preferably, the outer cylindrical housing 22 is flexible and/or compressible along the length thereof and fully or partially covers the liquid supply reservoir 14. The cutout or depression 100 can extend partially about the circumference of the outer cylindrical housing 22. Moreover, the liquid supply reservoir 14 is compressible such that when pressure is applied to the liquid supply reservoir, liquid is pumped from the liquid supply reservoir 14 to the capillary tube 18. A pressure activated switch 44 can be positioned beneath the liquid supply reservoir 14. When pressure is applied to the liquid supply reservoir 14 to pump liquid, the switch is also pressed and a heater 19 is activated. The heater 19 can be a portion of the capillary tube 18. By applying manual pressure to the pressure switch, the power supply 12 is activated and an electric current heats the liquid in the capillary tube 18 via electrical contacts so as to volatilize the liquid.

In the preferred embodiment, the liquid supply reservoir 14 is a tubular, elongate body formed of an elastomeric material so as to be flexible and/or compressible when squeezed. Preferably, the elastomeric material can be selected from the group consisting of silicone, plastic, rubber, latex, and combinations thereof.

Preferably, the compressible liquid supply reservoir 14 has an outlet 16 which is in fluid communication with a capillary tube 18 so that when squeezed, the liquid supply reservoir 14 can deliver a volume of liquid material to the capillary tube 18. Simultaneous to delivering liquid to the capillary, the power supply 12 is activated upon application of manual pressure to the pressure switch and the capillary tube 18 is heated to form a heated section wherein the liquid material is volatilized. Upon discharge from the heated capillary tube 18, the volatilized material expands, mixes with air and forms an aerosol.

Figure 5:
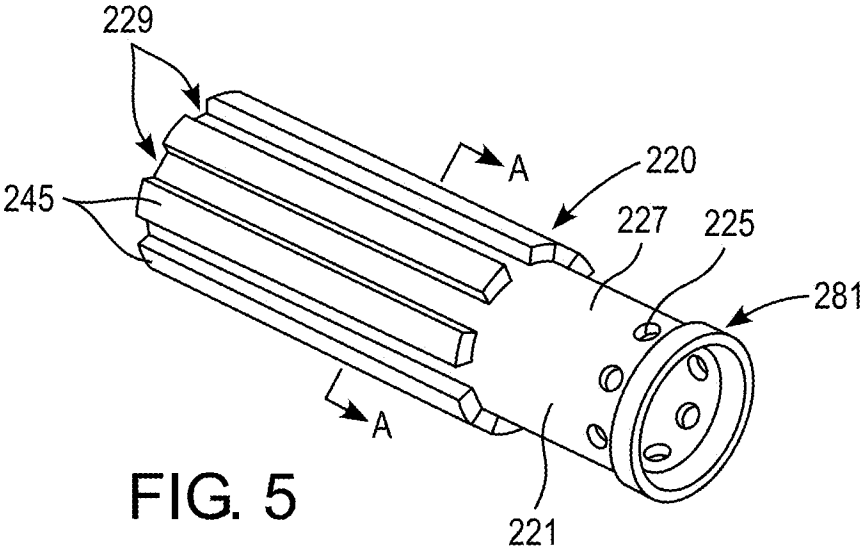
FIG. 5 is a perspective view of a sheath flow and aerosol promoter (SFAP) insert for use in an electronic smoking article.

Preferably, the liquid supply reservoir 14 extends longitudinally within the outer cylindrical housing 22 of the first section 70 (shown in FIGS. 7 and 8) or the middle section 73 (shown in FIG. 5). The liquid supply reservoir 14 comprises a liquid material which is volatilized when heated and forms an aerosol when discharged from the capillary tube 18.

In the preferred embodiment, the capillary tube 18 includes an inlet end 62 in fluid communication with the outlet 16 of the liquid supply reservoir 14, and an outlet end 63 (shown in FIG. 2) operable to expel volatilized liquid material from the capillary tube 18. In a preferred embodiment, as shown in FIGS. 2, 7 and 8, the liquid supply reservoir 14 may include or cooperate with a valve 40.

As shown in FIGS. 2 and 7, the valve 40 can be a check valve that is operable to maintain the liquid material within the liquid supply reservoir 14, but opens when the liquid supply reservoir 14 is squeezed and pressure is applied. Preferably, the check valve 40 opens when a critical, minimum pressure is reached so as to avoid inadvertent dispensing of liquid material from the liquid supply reservoir 14 or of inadvertent activation of the heater 19. Preferably, the critical pressure needed to open the check valve 40 is essentially equal to or slightly less than the pressure required to press a pressure switch 44 to activate the heater 19. Preferably, the pressure required to press the pressure switch 44 is high enough such that accidental heating is avoided. Such arrangement avoids activation of the heater 19 in the absence of liquid being pumped through the capillary.

Advantageously, the use of a check valve 40 aids in limiting the amount of liquid that is drawn back from the capillary upon release of pressure upon the liquid supply reservoir 14 (and/or the switch 44) if manually pumped so as to avoid air uptake into the liquid supply reservoir 14. Presence of air degrades pumping performance of the liquid supply reservoir 14.

Once pressure upon the liquid supply reservoir 14 is relieved, the valve 40 closes. The heated capillary tube 18 discharges liquid remaining downstream of the valve 40. Advantageously, the capillary tube 18 is purged once a smoker has stopped compressing the liquid supply reservoir 14 because any liquid remaining in the tube is expelled during heating.

The check valve of FIGS. 2 and 7 can be a one-way or non-return valve, which allows the liquid to flow in a single direction so as to prevent backflow or liquid and air bubbles in the liquid supply. The check valve can be a ball check valve, a diaphragm check valve, a swing check valve, a stop-check valve, a lift-check valve, an in-line check valve or a duckbill valve. To assure purging, the heating cycle may be extended by a controlled amount beyond release of pressure on the switch 44 and/or closure of the check valve 40.

Optionally, a critical flow orifice 41 is located downstream of the check valve 40 to establish a maximum flow rate of liquid to the capillary tube 18.

In other embodiments, as shown in FIG. 8, the valve 40 can be a two-way valve that is manually or electrically operable to allow passage of liquid from a pressurized liquid supply reservoir 14. In one embodiment, the electronic smoking article 60 is manually activated by pressing a button (pressure switch), which opens the valve 40 and simultaneously activates the heater 19. In other embodiments, the valve 40 and the heater 19 can be puff activated, such that when a smoker draws upon the electronic smoking article 60, the puff sensor 16 communicates with the control circuitry 11 to activate the heater 19 and open the valve 40.

Preferably, the two-way valve 40 is used when the liquid supply reservoir 14 is a pressurized liquid supply, as shown in FIG. 8. For example, the liquid supply reservoir 14 can be pressurized using a pressurization arrangement 405 which applies constant pressure to the liquid supply reservoir 14. For example, pressure can be applied to the liquid supply reservoir 14 using an internal or external spring and plate arrangement which constantly applies pressure to the liquid supply reservoir 14. Alternatively, the liquid supply reservoir 14 can be compressible and positioned between two plates that are connected by springs or the liquid supply reservoir 14 could be compressible and positioned between the outer housing and a plate that are connected by a spring so that the plate applies pressure to the liquid supply reservoir 14.

Preferably, the capillary tube 18 of FIGS. 2, 7 and 8 has an internal diameter of 0.01 to 10 mm, preferably 0.05 to 1 mm, and more preferably 0.05 to 0.4 mm. For example, the capillary tube can have an internal diameter of about 0.05 mm. Capillary tubes of smaller diameter provide more efficient heat transfer to the fluid because, with the shorter the distance to the center of the fluid, less energy and time is required to vaporize the liquid.

Also preferably, the capillary tube 18 may have a length of about 5 mm to about 72 mm, more preferably about 10 mm to about 60 mm or about 20 mm to about 50 mm. For example, the capillary tube 18 can be about 50 mm in length and arranged such that a downstream, about 40 mm long coiled portion of the capillary tube 18 forms a heated section 202 and an upstream, about 10 mm long portion 200 of the capillary tube 18 remains relatively unheated when the heater 19 is activated (shown in FIG. 1).

In one embodiment, the capillary tube 18 is substantially straight. In other embodiments, the capillary tube 18 is coiled and/or includes one or more bends therein to conserve space and/or accommodated a long capillary.

In the preferred embodiment, the capillary tube 18 is formed of a conductive material, and thus acts as its own heater 19 by passing current through the tube. The capillary tube 18 may be any electrically conductive material capable of being resistively heated, while retaining the necessary structural integrity at the operating temperatures experienced by the capillary tube 18, and which is non-reactive with the liquid material. Suitable materials for forming the capillary tube 18 are selected from the group consisting of stainless steel, copper, copper alloys, porous ceramic materials coated with film resistive material, Inconel® available from Special Metals Corporation, which is a nickel-chromium alloy, nichrome, which is also a nickel-chromium alloy, and combinations thereof.

In one embodiment, the capillary tube 18 is a stainless steel capillary tube 18, which serves as a heater 19 via electrical leads 26 attached thereto for passage of direct or alternating current along a length of the capillary tube 18. Thus, the stainless steel capillary tube 18 is heated by resistance heating. The stainless steel capillary tube 18 is preferably circular in cross section. The capillary tube 18 may be of tubing suitable for use as a hypodermic needle of various gauges. For example, the capillary tube 18 may comprise a 32 gauge needle has an internal diameter of 0.11 mm and a 26 gauge needle has an internal diameter of 0.26 mm.

In another embodiment, the capillary tube 18 may be a non-metallic tube such as, for example, a glass tube. In such an embodiment, the heater 19 is formed of a conductive material capable of being resistively heated, such as, for example, stainless steel, nichrome or platinum wire, arranged along the glass tube. When the heater arranged along the glass tube is heated, liquid material in the capillary tube 18 is heated to a temperature sufficient to at least partially volatilize liquid material in the capillary tube 18.

Preferably, at least two electrical leads 26 are bonded to a metallic capillary tube 18. In the preferred embodiment, the at least two electrical leads 26 are brazed to the capillary tube 18. Preferably, one electrical lead 26 is brazed to a first, upstream portion 101 of the capillary tube 18 and a second electrical lead 26 is brazed to a downstream, end portion 102 of the capillary tube 18, as shown in FIG. 2.

In use, once the capillary tube 18 of FIGS. 2, 7 and 8 is heated, the liquid material contained within a heated portion of the capillary tube 18 is volatilized and ejected out of the outlet 63 where it expands and mixes with air and forms an aerosol in a mixing chamber 46. The mixing chamber 46 can be positioned immediately upstream of an SFAP insert 220 (as shown in FIGS. 7, 8 and 9) or in a sheath flow and aerosol promoter (SFAP) insert 220 (shown in FIG. 2).

Preferably, the electronic smoking article 60 of each embodiment described herein also includes at least one air inlet 44 operable to deliver at least some air to the mixing chamber 46 and to a growth cavity 240, downstream of the mixing chamber 46. Preferably, air inlets 44 are arranged downstream of the capillary tube 18 so as to minimize drawing air along the capillary tube and thereby avoid cooling of the capillary tube 18 during heating cycles.

In one embodiment, the air inlets 44 can be upstream of an upstream end 281 of the SFAP insert 220, as shown in FIGS. 7 and 8. In other embodiments, the air inlets 44 can be superposed with the SFAP insert 220 as shown in FIG. 2. Optionally, air holes 225 in a wall 227 of the SFAP insert 220 (shown in FIG. 2), can allow some air to enter the mixing chamber 46 of the SFAP insert 220. Alternatively or in addition to the air holes, as shown in FIG. 2, air can travel through a gap 216 between the SFAP insert 220 and an inner surface 231 of the outer casing 22.

Figure 6:
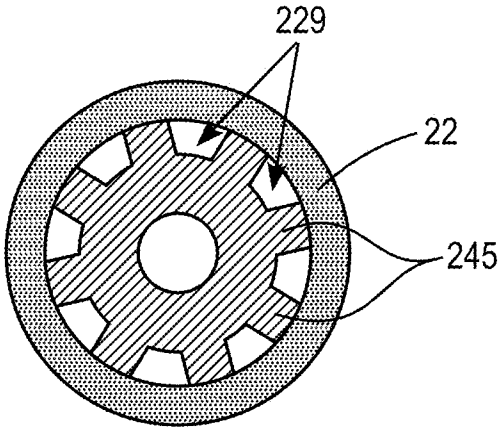
FIG. 6 is a cross-sectional view of the SFAP insert along line A-A of FIG. 5.

A portion of the air that enters via the air inlets 44 ("sheath air") can flow along an external surface of the SFAP insert 220 via channels 229 extending longitudinally along the external surface of the SFAP insert 220 between vanes 245 as shown in FIGS. 5 and 6. Preferably, about 80 to about 95% of the air entering the electronic smoking article 60 via the air inlets 44 passes into the mixing chamber 46, while about 5% to about 20% of the air passes through the channels 229 and enters a downstream growth cavity 240 as sheath air. Preferably, the vanes 245, shown in FIG. 5, extend longitudinally along an outer surface 227 of the SFAP insert 220 and in spaced apart relation so as to form the channels 229 therebetween.

Once the aerosol passes the mixing chamber 46, the aerosol passes through a constriction 230 in the SFAP insert 220, as shown in FIGS. 2, 7, 8 and 9. The aerosol then enters a downstream growth cavity 240 where the aerosol can mix with sheath air that has travelled through the channels 229. The sheath air acts as a barrier between an inner surface 231 of the growth cavity 240 and the aerosol so as to minimize deposition of the aerosol on walls of the growth cavity 240. Accordingly, the sheath air acts to increase the delivery rate of the aerosol and prevents losses due to condensation.

In the preferred embodiment, the at least one air inlet 44 includes one or two air inlets. Alternatively, there may be three, four, five or more air inlets. Altering the size and number of air inlets 44 can also aid in establishing the resistance to draw of the electronic smoking article 10. Preferably, the air inlets 44 communicate both with the channels 229 arranged between the SFAP insert 220 and the interior surface 231 of the outer casing 22 and with the mixing chamber 46, via air holes 225 as shown in FIG. 2 or directly with the mixing chamber 46 as shown in FIGS. 7 and 8.

In the preferred embodiment, the SFAP insert 220 is operable to provide an aerosol that is similar to cigarette smoke, has a mass median particle diameter of less than about 1 micron and aerosol delivery rates of at least about 0.01 $mg/cm^3$. Once the vapor is formed at the heater, the vapor passes to the mixing chamber 46 where the vapor mixes with air from the air holes and is cooled. The air causes the vapor to supersaturate and nucleate to form new particles. The faster the vapor is cooled the smaller the final diameter of the aerosol particles. When air is limited, the vapor will not cool as fast and the particles will be larger. Moreover, the vapor may condense on surfaces of the electronic smoking article resulting in lower delivery rates. The SFAP insert 220 abates deposition of the aerosol on surfaces of the electronic smoking article, as noted above, and quickly cools the aerosol so as to produce a small particle size and high delivery rates as compared to electronic smoking articles not including the SFAP insert as described herein.

Accordingly, the SFAP insert 220 can include a mixing chamber 46 immediately upstream of the SFAP insert 220

(as shown in FIGS. 7, 8 and 9) or inside the SFAP insert 220 (as shown in FIG. 2). The mixing chamber 46 leads to a constriction 230 having a reduced diameter as compared to the mixing chamber 46. Preferably, the diameter of the constriction 230 is about 0.125 inch to about 0.1875 inch and is about 0.25 inch to about 0.5 inch long. The constriction 230 leads to a growth cavity 240 which is about 2 inches in length and has a diameter of about 0.3125 inch. Preferably, the SFAP insert 220 is spaced about 0.2 to about 0.4 inch from an outlet 63 of the capillary tube 18. Moreover, channels 229 formed on the outer surface 221 of the SFAP insert 220 form about 10% of the total cross-sectional area of the SFAP insert 220 and allow sheath air to pass between the outer surface 221 of the SFAP insert 220 and an inner surface 231 of the outer cylindrical casing 22.

As noted above, the SFAP insert 220 can also be used in an electronic smoking article including a heater 319 and a filamentary wick 328 as shown in FIG. 9. The first section 70 includes an outer tube (or casing) 322 extending in a longitudinal direction and an inner tube (or chimney) 362 coaxially positioned within the outer tube 322. Preferably, a nose portion 361 of an upstream gasket (or seal) 320 is fitted into an upstream end portion 365 of the inner tube 362, while at the same time, an outer perimeter 367 of the gasket 320 provides a liquid-tight seal with an interior surface 97 of the outer casing 6. The upstream gasket 320 also includes a central, longitudinal air passage 315, which opens into an interior of the inner tube 362 that defines a central channel 321. A transverse channel 333 at an upstream portion of the gasket 320 intersects and communicates with the central channel 315 of the gasket 320. This channel 333 assures communication between the central channel 315 and a space 335 defined between the gasket 320 and a threaded connection 74.

Preferably, a nose portion 393 of a downstream gasket 310 is fitted into a downstream end portion 381 of the inner tube 362. An outer perimeter 382 of the gasket 310 provides a substantially liquid-tight seal with an interior surface 397 of the outer casing 322. The downstream gasket 310 includes a central channel 384 disposed between the central passage 321 of the inner tube 362 and the SFAP insert 220.

In this embodiment, the liquid supply reservoir 314 is contained in an annulus between an inner tube 362 and an outer casing 322 and between the upstream gasket 320 and the downstream gasket 310. Thus, the liquid supply reservoir 314 at least partially surrounds the central air passage 231. The liquid supply reservoir 314 comprises a liquid material and optionally a liquid storage medium (not shown) operable to store the liquid material therein.

The inner tube 362 has a central air passage 321 extending therethrough which houses the heater 319. The heater 319 is in contact with the wick 328, which preferably extends between opposing sections of the liquid supply reservoir 314 so as to deliver liquid material from the liquid supply reservoir 314 to the heater 319 by capillary action.

The power supply 12 of each embodiment can include a battery arranged in the electronic smoking article 60. The power supply 12 is operable to apply voltage across the heater 19 associated with the capillary tube 18 or the heater 319 associated with the wick 328 of FIG. 9. Thus, the heater 19, 319 volatilizes liquid material according to a power cycle of either a predetermined time period, such as a 2 to 10 second period.

Preferably, the electrical contacts or connection between the heater 19, 319 and the electrical leads 26 are highly conductive and temperature resistant while the heater 19, 319 is highly resistive so that heat generation occurs primarily along the heater 19 and not at the contacts.

The battery can be a Lithium-ion battery or one of its variants, for example a Lithium-ion polymer battery. Alternatively, the battery may be a Nickel-metal hydride battery, a Nickel cadmium battery, a Lithium-manganese battery, a Lithium-cobalt battery or a fuel cell. In that case, preferably, the electronic smoking article 10 is usable by a smoker until the energy in the power supply is depleted. Alternatively, the power supply 12 may be rechargeable and include circuitry allowing the battery to be chargeable by an external charging device. In that case, preferably the circuitry, when charged, provides power for a predetermined number of puffs, after which the circuitry must be re-connected to an external charging device.

Preferably, the electronic smoking article 60 of each embodiment also includes control circuitry which can be on a printed circuit board 11 (shown in FIGS. 2, 7, 8 and 9). The control circuitry 11 can also include a heater activation light 27 that is operable to glow when the heater 19, 319 is activated. Preferably, the heater activation light 27 comprises at least one LED and is at an upstream end 28 of the electronic smoking article 60 so that the heater activation light 27 takes on the appearance of a burning coal during a puff. Moreover, the heater activation light 27 can be arranged to be visible to the smoker. In addition, the heater activation light 27 can be utilized for smoking article system diagnostics. The light 27 can also be configured such that the smoker can activate and/or deactivate the light 27 when desired, such that the light 27 would not activate during smoking if desired.

The time-period of the electric current supply to the heater 19 may be pre-set depending on the amount of liquid desired to be vaporized. The control circuitry 11 can be programmable and can include a microprocessor programmed to carry out functions such as heating the capillary tubes and/or operating the valves. In other embodiments, the control circuitry 11 can include an application specific integrated circuit (ASIC).

In the preferred embodiment, the liquid supply reservoir 14 of FIGS. 2, 7, 8, and 9 includes a liquid material which has a boiling point suitable for use in the electronic smoking article 60. If the boiling point is too high, the heater 19, 319 will not be able to vaporize liquid in the capillary tube 18. However, if the boiling point is too low, the liquid may vaporize without the heater 19, 319 being activated.

Preferably, the liquid material includes a tobacco-containing material including volatile tobacco flavor compounds which are released from the liquid upon heating. The liquid may also be a tobacco flavor containing material and/or a nicotine-containing material. Alternatively, or in addition, the liquid may include a non-tobacco material and/or may be nicotine-free. For example, the liquid may include water, solvents, ethanol, plant extracts and natural or artificial flavors. Preferably, the liquid further includes an aerosol former. Examples of suitable aerosol formers are glycerine, propylene carbonate, oils, such as corn oil or canola oil, fatty acids, such as oleic acid, and propylene glycol.

As shown in FIGS. 2, 7, 8 and 9 the electronic smoking article 60 further includes a mouth-end insert 20 having at least two off-axis, preferably diverging outlets 21. Preferably, the mouth-end insert 20 is in fluid communication with the mixing chamber 46 and includes at least two diverging outlets 21. (e.g, 3, 4, 5, or preferably 6 to 8 outlets or more). Preferably, the outlets 21 of the mouth-end insert 20 are located at ends of off-axis passages 23 and are angled outwardly in relation to the longitudinal direction of the electronic smoking article 10 (i.e., divergently). As used herein, the term "off-axis" denotes at an angle to the longitudinal direction of the electronic smoking article. Also preferably, the mouth-end insert (or flow guide) 20 includes outlets uniformly distributed around the mouth-end insert 20 so as to substantially uniformly distribute aerosol in a smoker's mouth during use. Thus, as the aerosol passes into a smoker's mouth, the aerosol enters the mouth and moves in different directions so as to provide a full mouth feel as compared to electronic smoking articles having an on-axis single orifice which directs the aerosol to a single location in a smoker's mouth.

In addition, the outlets 21 and off-axis passages 23 are arranged such that droplets of unaerosolized liquid material carried in the aerosol impact interior surfaces 25 of the mouth-end insert 20 and/or interior surfaces of the off-axis passages 23 such that the droplets are removed or broken apart. In the preferred embodiment, the outlets 21 of the mouth-end insert 20 are located at the ends of the off-axis passages 23 and are angled at 5 to 60° with respect to the central longitudinal axis of the electronic smoking article 10 so as to more completely distribute aerosol throughout a mouth of a smoker during use and to remove droplets.

Preferably, each outlet 21 has a diameter of about 0.015 inch to about 0.090 inch (e.g., about 0.020 inch to about 0.040 inch or about 0.028 inch to about 0.038 inch). The size of the outlets 21 and off-axis passages 23 along with the number of outlets 21 can be selected to adjust the resistance to draw (RTD) of the electronic smoking article 10, if desired.

Figure 3:
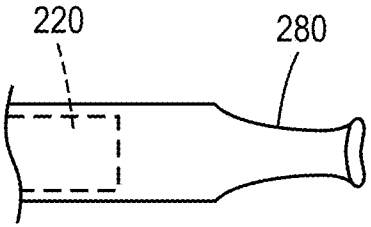
FIG. 3 is a side view of an alternative mouth end tip for use with an electronic smoking article.

Alternatively, as shown in FIG. 3, a tip 280 can be attached to the electronic smoking article 60 in place of the mouth end insert 20. The SFAP insert 220 can be positioned within the tip 280 and sheath air can pass through channels between the SFAP insert 220 and an inner surface of the tip 280.

Figure 4:
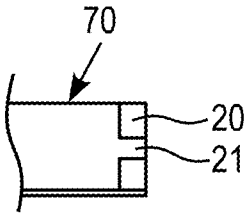
FIG. 4 is a partial, cross-sectional view of a first section of an electronic smoking article including an alternative mouth end insert.

In another embodiment, as shown in FIG. 4, the mouth end insert 20 can include a single central outlet 21. Preferably, the mouth-end insert 20 is affixed within the outer cylindrical housing 22 of the cartridge 72.

In a preferred embodiment, the electronic smoking article 10 is about the same size as a conventional smoking article. In some embodiments, the electronic smoking article 60 can be about 80 mm to about 110 mm long, preferably about 80 mm to about 100 mm long and about 7 mm to about 8 mm in diameter. For example, in an embodiment, the electronic smoking article is about 84 mm long and has a diameter of about 7.8 mm.

The outer cylindrical housing 22 of the electronic smoking article 10 may be formed of any suitable material or combination of materials. Preferably, the outer cylindrical housing 22 is formed of metal and is part of the electrical circuit. Examples of other suitable materials include metals, alloys, plastics or composite materials containing one or more of those materials, or thermoplastics that are suitable for food or pharmaceutical applications, for example polypropylene, polyetheretherketone (PEEK), ceramic, low density polyethylene (LDPE) and high density polyethylene (HDPE). Preferably, the material is light and non-brittle.

In the embodiment shown in FIGS. 2 and 7, at least a portion of the outer cylindrical housing 22 can be elastomeric so as to allow a smoker to squeeze the liquid supply reservoir 14 during smoking to release liquid material therefrom and activate the heater 19. Thus, the outer cylindrical housing 22 can be formed of a variety of materials including plastics, rubber and combinations thereof. In a preferred embodiment, the outer cylindrical housing 22 is formed of silicone. The outer cylindrical housing 22 can be any suitable color and/or can include graphics or other indicia printed thereon.

In an embodiment, the volatilized material formed as described herein can at least partially condense to form an aerosol including particles. Preferably, the particles contained in the vapor and/or aerosol range in size from about 0.1 micron to about 4 microns, preferably about 0.03 micron to about 2 microns. In the preferred embodiment, the vapor and/or aerosol has particles of about 1 micron or less, more preferably about 0.8 micron or less. Also preferably, the particles are substantially uniform throughout the vapor and/or aerosol.

Referring now to FIG. 9, it is contemplated that the heater 319 and wick 328 could be located between the reservoir 314 and the SFAP insert 220, and that the reservoir 314 could be in the form of a tank (essentially free of any fibrous medium) with or without a central air passage 321, wherein the air passage 321 might be routed about the tank reservoir 314.

The teachings herein are adaptable to all forms of electronic smoking articles such as electronic cigarettes, cigars, pipes, hookahs, and others, regardless of their size or shape.

When the word "about" is used in this specification in connection with a numerical value, it is intended that the associated numerical value include a tolerance of ±10% around the stated numerical value. Moreover, when reference is made to percentages in this specification, it is intended that those percentages are based on weight, i.e., weight percentages.

Moreover, when the words "generally" and "substantially" are used in connection with geometric shapes, it is intended that precision of the geometric shape is not required but that latitude for the shape is within the scope of the disclosure. When used with geometric terms, the words "generally" and "substantially" are intended to encompass not only features which meet the strict definitions but also features which fairly approximate the strict definitions.

It will now be apparent that a new, improved, and non-obvious electronic smoking article has been described in this specification with sufficient particularity as to be understood by one of ordinary skill in the art. Moreover, it will be apparent to those skilled in the art that numerous modifications, variations, substitutions, and equivalents exist for features of the electronic smoking article which do not materially depart from the spirit and scope of the invention. Accordingly, it is expressly intended that all such modifications, variations, substitutions, and equivalents which fall within the spirit and scope of the invention as defined by the appended claims shall be embraced by the appended claims.

We claim:

1. A cartridge of an electronic vaping article comprising:

an outer housing extending in a longitudinal direction, the outer housing having a mouth end;

a sheath flow and aerosol promoter (SFAP) insert in the outer housing, the SFAP insert defining a flow passage through the SFAP insert and a SFAP insert outlet at an end of the flow passage and in fluid communication with the mouth end, an airflow gap defined by an outer surface of the SFAP insert and an inner surface of the outer housing;

at least one air inlet in the outer housing;

a distal end of the outer housing opposite the mouth end, the distal end including a connector assembly; and a mixing portion defined by an inner surface of the SFAP insert at a distal end of the SFAP insert corresponding to the distal end of the outer housing, the at least one air inlet in the outer housing configured to provide air to the mixing portion, the airflow gap extending around the mixing portion of the SFAP insert, the airflow gap configured to conduct a portion of air around the SFAP insert separate from the portion of air entering the mixing portion.

2. The cartridge of claim 1, wherein the SFAP insert comprises:

a plurality of air holes in a wall of the SFAP insert.

3. The cartridge of claim 2, wherein the SFAP insert further comprises:

a constricting portion extending longitudinally through a central portion of the SFAP insert, the SFAP insert configured to direct a vapor through the constricting portion, such that the vapor exits the SFAP insert via the SFAP insert outlet.

4. The cartridge of claim 3, wherein the constricting portion is between the SFAP insert outlet and the plurality of air holes.

5. The cartridge of claim 1, wherein the outer housing defines a cavity between the SFAP insert and the mouth end of the outer housing.

6. The cartridge of claim 1, wherein the at least one air inlet is configured to provide air to the airflow gap.

7. The cartridge of claim 6, wherein the outer housing includes the at least one air inlet superimposed with the SFAP insert.

8. The cartridge of claim 6, wherein the at least one air inlet is upstream of the SFAP insert.

9. The cartridge of claim 1, wherein the airflow gap is at least partially defined by one or more longitudinally extending vanes on the outer surface of the SFAP insert.

10. The cartridge of claim 2, further comprising:

a heater in the outer housing; and a reservoir configured to supply a pre-vapor formulation to the heater.

11. The cartridge of claim 10, wherein the heater is a coil heater in communication with a wick.

12. The cartridge of claim 11, wherein the reservoir is contained in an outer annulus between the outer housing and an inner tube.

13. The cartridge of claim 12, wherein the coil heater is located in the inner tube and the wick is in communication with the reservoir and surrounded by the coil heater, and the coil heater is configured to heat the pre-vapor formulation delivered from the reservoir by the wick.

14. The cartridge of claim 1, further including, a mouth-end insert at the mouth end of the outer housing.

15. The cartridge of claim 1, wherein the mouth end includes at least two diverging outlets angled outwardly in relation to the longitudinal direction.

16. The cartridge of claim 10, wherein an upstream end of the SFAP insert is downstream from the heater.

17. The cartridge of claim 10, wherein the at least one air inlet is downstream from the heater.

18. The cartridge of claim 14, wherein the outer housing defines a cavity between the SFAP insert and the mouth end insert.

* * * * *